United States Patent [19]

Kato et al.

[11] Patent Number: 4,882,253

[45] Date of Patent: Nov. 21, 1989

[54] ORGANIC LAMINATED PHOTOSENSITIVE MATERIAL OF POSITIVE CHARGING TYPE

[75] Inventors: Yoshiaki Kato, Ikaruga; Masashi Tanaka, Izumi-Ohtsu; Mitsuji Tsujita, Osaka; Keizo Kimoto, Sakai; Hirotsugu Nishikawa, Osaka; Mika Kawaguchi, Neyagawa, all of Japan

[73] Assignee: Mita Industrial Co., Ltd., Osaka, Japan

[21] Appl. No.: 225,522

[22] Filed: Jul. 28, 1988

[30] Foreign Application Priority Data

Jul. 29, 1987 [JP] Japan ..... 62-187646

[51] Int. Cl.[4] ..... G03G 5/14

[52] U.S. Cl. ..... 430/59; 430/58

[58] Field of Search ..... 430/58, 59

[56] References Cited

FOREIGN PATENT DOCUMENTS 62-92962 4/1987 Japan .

*Primary Examiner*—Roland E. Martin

*Attorney, Agent, or Firm*—Sherman and Shalloway

[57] ABSTRACT

Disclosed is an organic laminated photosensitive material of the positive charging type comprising an electroconductive substrate, a charge-transporting layer formed on the substrate and a charge-generating and transporting layer formed on the charge-transporting layer. The charge-transporting layer is composed of a binder resin containing a hole-transporting substance, and the charge-generating and transporting layer is composed of a binder resin containing a charge-generating substance and a hole-transporting substance. In this laminated photosensitive material, an excellent sensitiveity is maintained even if the topmost charge-generating layer has a large thickness, and therefore, a high surface saturation charge voltage and an excellent printing resistance can be maintained in addition to an increased sensitivity.

10 Claims, 1 Drawing Sheet

ORGANIC LAMINATED PHOTOSENSITIVE MATERIAL OF POSITIVE CHARGING TYPE

BACKGROUND OF THE INVENTION

1. Field of the Invention

The present invention relates to an organic laminated photosensitive material of the positive charging type which has a high saturation charge voltage, an increased sensitivity and an excellent printing resistance.

2. Description of the Prior Art

A photosensitive material for the electrophotography comprising an electroconductive substrate and a layer of an inorganic or organic photoconductor formed on the substrate has been widely used. As a kind of this photosensitive layer, there is known a so-called function-separated organic photosensitive material in which a charge-generating substance and a charge-transporting substance are combined by lamination or dispersion.

Most of known function-separated organic photosensitive materials are of the negative charging type, but photosensitive materials of the negative charging type involve a problem in that ozone is generated at the time of charging. Accordingly, organic photosensitive materials of the positive charging type are eagerly desired.

As the organic photosensitive material of the positive charging type, there is known an organic photosensitive material comprising a charge-generating layer laminated on a charge-transporting layer having a hole-transporting property. In the organic photosensitive material, if the thickness of the carrier-generating layer (charge-generating layer) is not reduced, injection of charges is not sufficiently performed, and if the thickness of the charge-generating layer is reduced, the abrasion resistance is poor and the printing resistance is degraded.

As means for overcoming this defect, Japanese Patent Application Laid-Open Specification No. 92962/87 discloses a photosensitive material comprising a carrier-generating layer (charge-generating layer) comprising anthanthrone bromide as the carrier-generating substance, a carrier-transporting substance and a binder resin, in which the content of anthanthrone bromide is 10 to 300% by weight based on the binder, the content of the carrier-transporting substance is 20 to 200% by weight based on the binder and the carrier-transporting substance/anthanthrone bromide weight ratio is from 0.2 to 3.0. It is taught and known that in this photosensitive material, a highest sensitivity is obtained if the thickness of the carrier-generating layer is smaller than 5 μm.

This known photosensitive material is significant in that by incorporating the charge-transporting substance in the charge-generating layer, injection of holes in the charge-transporting layer can be performed smoothly even if the topmost charge-generating layer is relatively thick. However, the thickness of the charge-generating layer is still limited from the viewpoint of the sensitivity, and it has been confirmed that if the thickness exceeds the level giving the maximum sensitivity, the sensitivity is drastically reduced.

As pointed out hereinbefore, increase of the thickness of the topmost charge-generating layer is preferred for improving the printing resistance of the photosensitive material and increasing the surface saturation charge voltage (increasing the contrast). Therefore, development of a photosensitive material having an increased sensitivity irrespectively of increase of the thickness of the charge-generating layer is eagerly desired in the art.

SUMMARY OF THE INVENTION

It is therefore a primary object of the present invention to provide an organic laminated photosensitive material of the positive charging type having a high surface saturation charge voltage, an increased sensitivity and an excellent printing resistance in combination, in which the defects of the conventional techniques are overcome.

More specifically, in accordance with the present invention, there is provided an organic laminated photosensitive material comprising an electroconductive substrate, a charge-transporting layer formed on the substrate and a charge-generating and transporting layer formed on the charge-transporting layer, wherein the charge-transporting layer is composed of a binder resin containing a hole-transporting substance, and the charge-generating and transporting layer contains a charge-generating substance and a hole-transporting substance at a weight ratio of from 1/3.5 to 1/40 and has a charge-generating substance content of 10 to 1% by weight based on the sum of the hole-transporting substance and binder and a thickness of 5 to 30 μm.

DETAILED DESCRIPTION OF THE PREFERRED EMBODIMENTS

Figure 1:
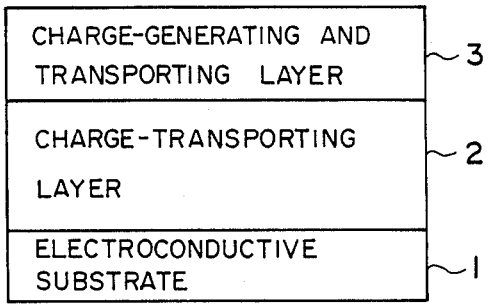
FIG. 1 is a diagram illustrating the structure of the organic laminated photosensitive material of the positive charging type according to the present invention.

Referring to FIG. 1 illustrating the sectional structure of the organic laminated photosensitive material of the positive charging type according to the present invention, this photosensitive material comprises an electroconductive substrate 1, a charge-transporting layer 2 formed on the substrate and a charge-generating and transporting layer formed on the charge-transporting layer. The charge-transporting layer 2 is composed of a binder resin containing a hole-transporting substance (CTM), and the charge-generating and transporting layer 3 is composed of a binder containing a charge-generating substance (CGM) and a hole-transporting substance (CTM) at a sepcific ratio described hereinafter.

If this photosensitive material is positively charged and exposed to light imagewise, holes generated in the charge-generated and transporting layer 3 are moved in the layer 3 by the hole-transporting substance (CTM) contained in the layer 3 and injected into the charge-transporting layer 2 and are cancelled by the negative polarity of the substrate to form an electrostatic image.

The present invention is based on the finding that if the concentration of the charge-generating substance (CGM) in the charge-generating and transporting layer 3 is reduced to about 1/10 of the level adopted in the above-mentioned conventional technique and absorption is effected not only in the surface of the charge-generating and transporting layer 3 but also along the entire thickness direction of the layer 3, the thickness of the charge-generating and transporting layer showing the maximum sensitivity can be greatly shifted to the large thickness side. According to the present invention, an organic photosensitive material of the positive charging type having a very high sensitivity can be obtained while increasing the thickness of the topmost charge-generating and transporting layer of the photosensitive material, and because of this increase of the thickness of the charge-generating and transporting layer, a high surface saturation charge voltage and an excellent printing resistance can be attained in combination.

In view of the sensitivity of the photosensitive material, it is important that in the charge-generating and transporting layer, the concentration of the charge-generating substance should be 10 to 1% by weight, especially 6 to 2% by weight, based on the sum of the hole-transporting substance and binder resin.

If this concentration is too high and exceeds the above-mentioned range, no satisfactory sensitivity can be obtained unless the thickness is drastically reduced.

If the concentration is too low and below this range, since absorption of light and generation of charges in the charge-generating and transporting layer are reduced, lowering of the sensitivity is caused.

In order to attain the object of the present invention, it is important that in the charge-generating and transporting layer, the charge-generating substance and the hole-transporting substance should be present at a weight ratio of from 1/3.5 to 1/40, especially from 1/5 to 1/20. In the charge-generating and transporting layer of the photosensitive material of the present invention, the hole-transporting substance is contained at a higher content than in the photosensitive material of the above-mentioned conventional technique, and this means that even in the charge-generating and transporting layer of the present invention in which the concentration of the charge-generating substance is low and the thickness of the layer is increased, migration of holes in the layer is facilitated and injection of holes in the charge-transporting layer is smoothly performed. If the ratio of the hole-transporting substance is outside the above-mentioned range, the sensitivity is lower than the sensitivity attained according to the present invention.

It is preferred that the thickness of the charge-generating and transporting layer be 5 to 30 μm, especially 10 to 20 μm. If the thickness is too small and below this range, reduction of the surface saturation charge voltage, the sensitivity or the printing resistance is often caused. If the thickness is too large and exceeds the above-mentioned range, the sensitivity is reduced, and the residual voltage is increased to have bad influences on the printing resistance.

The respective elements of the photosensitive material of the present invention will now be described.

Electroconductive Substrate

The electroconductive substrate may be in the form of a sheet or a drum. A substrate which is electrically conductive by itself and a substrate having an electroconductive surface and showing a sufficient mechanical strength during the use are preferred. Various materials having an electric conductivity can be used as the electroconductive substrate. For example, there can be mentioned single layers of metals such as aluminum, an aluminum alloy, copper, tin, platinum, gold, silver, vanadium, molybdenum, chromium, cadmium, titanium, nickel, palladium, indium, stainless steel and brass, or the electroconductive resin composition containing the above-mentioned electroconductive materials and plastic materials and glass sheets having layers of the above-mentioned metals, indium oxide, tin oxide, carbon and the like formed by vacuum deposition or the like.

Charge-Transporting Layer

In the present invention, the charge-transporting layer formed on the electroconductive substrate is composed of a binder resin containing a hole-transporting substance, as described hereinbefore. Any of known hole-transporting substances can be used without any limitation as the hole-transporting substance to be contained in the charge-transporting layer. As preferred examples, there can be mentioned poly-N-vinylcarbazole, phenanthrene, N-ethylcarbazole, 2,5-diphenyl-1,3,4-oxadiazole, 2,5-bis-(4-diethylaminophenyl)-1,3,4-oxadiazole, bis-diethylaminophenyl-1,3,6-oxadiazole, 4,4'-bis(diethylamino-2,2'-dimethyltriphenyl)methane, 2,4,5-triaminophenylimidazole, 2,5-bis(4-diethylaminophenyl)-1,3,4-triazole, 1-phenyl-3-(4-diethylaminostyryl)-5-(4-diethylaminophenyl)-2-pyrazoline, p-diethylaminobenzaldehydo(diphenylhydrazone), N-ethylcarbazole-3-carbaldehydo-diphenylhydrazine, N,N,N',N'-tetraphenylbenzidine and 1,1-diphenyl-4,4-di-N-diethyl-p-anilyl-1,3-butadiene. Among them, 1,1-diphenyl-4,4-di-N-diethyl-p-anilyl-1,3-butadiene, N-carbazole-3-carbaldehydo-dipyhenylhydrazone, p-diethylaminobenzaldehydo-(diphenylhydrazone) and N,N,N',N'-tetrabenzidine are preferred.

Various resins can be used as the binder resin. For example, there can be mentioned a styrene polymer, a styrene/butadiene copolymer, a styrene/acrylonitrile copolymer, a styrene/maleic acid copolymer, an acrylic polymer, a styrene/acrylic copolymer, an ethylene/vinyl acetate copolymer, polyvinyl chloride, a vinyl chloride/vinyl acetate copolymer, a polyester, an alkyd resin, a polyamide, a polyurethane, an epoxy resin, a polycarbonate, a polyacrylate, a polysulfone, a diallyl phthalate resin, a silicone resin, a ketone resin, a polyvinyl butyral resin, a polyether resin, a phenolic resin, and photo-curing resins such as an epoxy acrylate and a urethane acrylate. Incidentally, a photoconductive polymer such as poly-N-vinylcarbazole can also be used as the binder resin.

It is preferred that in the charge-transporting layer, the hole-transporting substance be present in an amount of 50 to 300% by weight, especially 75 to 200% by weight, based on the binder resin. Furthermore, it is preferred that the thickness of the charge-transporting layer be 5 to 40 μm, especially 10 to 30 μm.

Charge-Generating and Transporting Layer

The charge-generating and transporting layer formed on the above-mentioned charge-transporting layer is composed of a binder resin containing a charge-generating substance and a hole-transporting substance.

The above-mentioned hole-transporting substances can be used as the hole-transporting substance to be contained in the charge-generating and transporting layer. It is generally preferred that the same hole-transporting substance as present in the charge-transporting layer be used also for the charge-generating and transporting layer. An appropriate binder resin can be selected from those mentioned above and used for the charge-generating and transporting layer.

Known charge-generating substances can be used for the charge-generating and transporting layer without any limitation. For example, there can be used pyrylium salts, azo pigments, disazo pigments, trisazo dyes, anthanthrone pigments, phthalocyanine pigments, indigo pigments, triphenylmethane pigments, threne pigments, toluidine pigments, pyrazoline pigments, perylene pigments, quinacridone pigments and dibromoanthanthrone. In the present invention, dibromoanthanthrone, phthalocyanine, Chlorodian Blue and perylene are preferred.

Preferred combinations of the charge-generating substance and the hole-transporting substance are illustrated in the examples given hereinbelow.

Preparation of Laminated Photosensitive Material

In the production of the laminated photosensitive material of the present invention, a solution of the binder resin and hole-transporting substance in an organic solvent is prepared, and the solution is coated and dried on the surface of the electroconductive substrate to form a charge-transporting layer. Furthermore, the binder resin and hole-transporting substance are dissolved in an organic solvent and the charge-generating substance is dispersed in the solution to form a coating liquid, and the coating liquid is coated and dried on the charge-transporting layer to form a charge-generating and transporting layer.

Incidentally, the organic solvent used for formation of the coating liquid for formation of the charge-generating and transporting layer should not be one dissolving the charge-transporting layer formed on the substrate.

According to the present invention, by increasing the thickness of the charge-generating and transporting layer on the top surface of the photosensitive material, an organic photosensitive material of the positive charging type having a very high sensitivity can be obtained, and by this increase of the thickness, an increase of the contrast by a high surface saturation charge voltage and an excellent printing resistance can be obtained.

The effects of the present invention will now be described in detail with reference to the following examples.

EXAMPLES

The following charge-generating substances were used in the examples.

(I) Dibromoanthanthrone
(II) Phthalocyanine
(III) Chlorodian Blue
(IV) Perylene

The following hole-transporting substances were used in the examples.

(a) 1,1-Diphenyl-4,4-di-N-diethyl-p-anilyl-1,3-butadiene of the following formula:

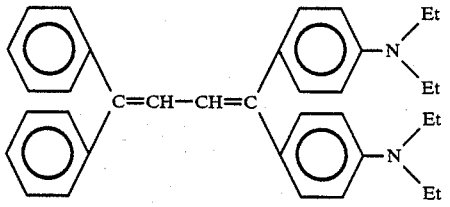

(b) N-Ethylcarbazole-3-carbaldehydodiphenylhydrazone of the following formula:

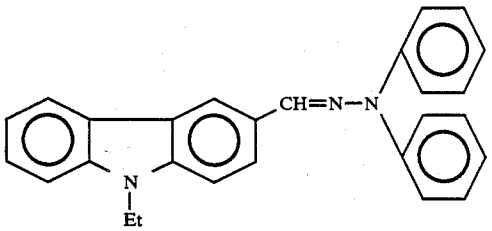

(c) Diethylaminobenzaldehydodiphenylhydrazone of the following formula:

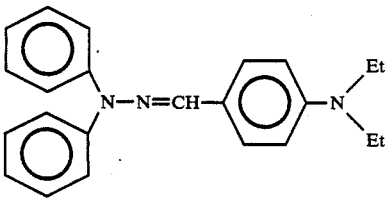

(d) N,N,N',N'-Tetraphenylbenzidine of the following formula:

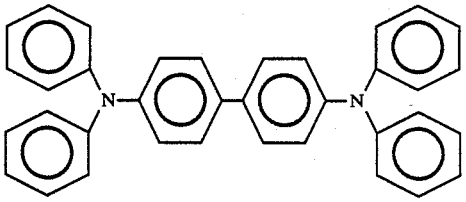

(e) N,N,N',N'-p-Tetratoluyl-2,2'-dimethylbenzidine of the following formula:

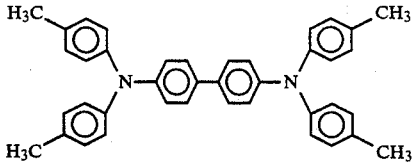

(f) N,N-2,3-diemthylphenyl-N,N'-diphenylbenzidine of the following formula:

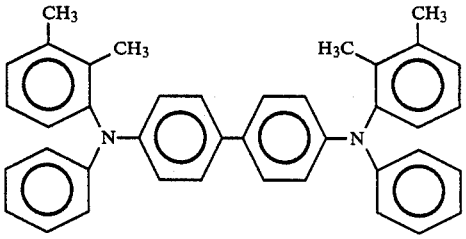

Samples of Examples 1 through 17 and Comparative Examples 1 through 5 having a thickness shown in Table 1 were prepared by using the above-mentioned charge-generating substance and hole-transporting substance at a weight ratio shown in Table 1 in the following manner.

The hole-transporting substance and a polycarbonate resin were dissolved in tetrahydrofuran, and the solution was coated and dried on an aluminum foil to form a charge-transporting layer.

Then, a tetrahydrofuran solution of the charge-generating substance, the hole-transporting substance and a polycarbonate resin was dispersed for 10 hours in a ball mill to form a coating liquid for formation of a charge-generating layer. The coating liquid was coated on the charge-transporting layer and dried to form a charge-generating and transporting layer, whereby a photosensitive material having a laminate structure.

The so-obtained electrophotographic photosensitive material was attached to an electrostatic tester (Model SP-428 supplied by Kawaguchi Denki Seisakusho), and the following properties were tested.

More specifically, a voltage of +5.5 KV was applied to a charger and the photosensitive layer was electrified for 2 seconds by corona discharge, and the photosensitive layer was allowed to stand still for 2 seconds (the voltage at this point is designated as "Vo"). Then, the photosensitive layer was irradiated with light of a tungsten lamp so that the illuminance on the surface of the photosensitive layer was 10 lux, and the light exposure quantity ($E\frac{1}{2}$) required for attenuating the surface voltage of the photosensitive layer to $\frac{1}{2}$ was measured.

Furthermore, after 20,000 prints were obtained by copying, Vo and $E\frac{1}{2}$ were measured.

The measurement results are shown in Table 2.

From the results shown in Table 2, it is seen that each of the samples of Examples 1 through 11 is an excellent photosensitive material having good initial charging characteristics and a small half-value light exposure quantity and the electrophotographic characteristics are not substantially changed even after the copying operation has been conducted 20,000 times.

On the other hand, it is seen that in the samples of Comparative Examples 1 through 3 are inferior in the charging characteristics and have a large half-value light exposure quantity. It also is seen that although the samples of Comparative Examples 1 and 3 having a thin charge-generating and transporting layer (3 to 5 μm) have good initial characteristics, if the copying operation is conducted 20,000 times, the thickness of the charge-generating and transporting layer is drastically reduced by wearing and the charge-generating efficiency is reduced, with the result that the sensitivity is drastically degraded.

Figure 2:
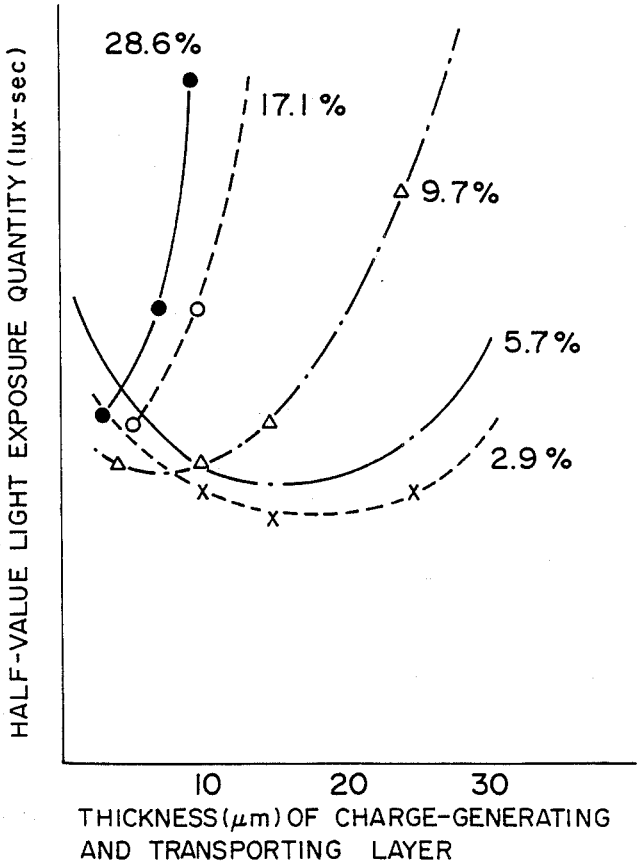
FIG. 2 is a graph illustrating the relation between the thickness of the charge-transporting and transporting layer and half-value light exposure quantity.

A graph illustrating the relation between the thickness of the charge-generating and transporting layer and the half-value light exposure quantity, determined from the foregoing measurement results, is shown in FIG. 2.

Incidentally, each numerical figure indicates the concentration (hereinafter referred to as "CG concentration") of the charge-generating substance based on the sum of the hole-transporting substance and binder resin in the charge-generating and transporting layer. From FIG. 2, it is seen that at the conventionally adopted CG concentration (17.1%, 28.6% or higher), the thickness of the charge-generating and transporting layer cannot be reduced below 10 μm and the change of the half-value light exposure quantity according to the change of the thickness is great. In contrast, if the CG concentration is lower than 10%, a practically satisfactory photosensitive material can be provided while the thickness of the charge-generating and transporting layer is in the range of from 5 to 30 μm, and the sensitivity is stable and is not substantially changed even if the thickness of the charge-generating and transporting layer is worn during the copying operation.

TABLE 1

| | | | Charge-generating Layer | | | | | Charge-transporting Layer | | |
|---|---|---|---|---|---|---|---|---|---|---|
| | | | Weight Ratio | | | $\frac{CG}{CT + Resin} \times 100(\%)$ | Thickness (μm) | Weight Ratio | | Thickness (μm) |
| | CGM | CTM | CG | CT | Resin | | | CT | Resin | |
| Example 1 | (I) | (a) | 1 | 7.5 | 10 | 5.7 | 6 | 7.5 | 10 | 5 |
| Example 2 | " | " | " | " | " | " | 10 | " | " | " |
| Example 3 | " | " | " | " | " | " | 15 | " | " | " |
| Example 4 | " | " | " | " | " | " | 25 | " | " | " |
| Example 5 | " | " | 0.5 | " | " | 2.9 | 7 | " | " | " |
| Example 6 | " | " | " | " | " | " | 10 | " | " | " |
| Example 7 | " | " | " | " | " | " | 15 | " | " | " |
| Example 8 | " | " | " | " | " | " | 25 | " | " | " |
| Example 9 | " | " | 1.7 | " | " | 9.7 | 4 | " | " | " |
| Example 10 | " | " | " | " | " | " | 10 | " | " | " |
| Example 11 | " | " | " | " | " | " | 15 | " | " | " |
| Example 12 | " | " | " | " | " | " | 25 | " | " | " |
| Example 13 | (II) | (b) | 1 | 7.5 | " | 5.7 | 10 | " | " | " |
| Example 14 | (III) | (c) | " | " | " | " | " | " | " | " |
| Example 15 | (IV) | (d) | " | " | " | " | " | " | " | " |
| Example 16 | (I) | (e) | " | " | " | " | " | " | " | " |
| Example 17 | " | (f) | " | " | " | " | " | " | " | " |
| C. Ex. 1 | " | (a) | 3 | " | " | 17.1 | 5 | " | " | " |
| C. Ex. 2 | " | " | " | " | " | " | 10 | " | " | " |
| C. Ex. 3 | " | " | 5 | " | " | 28.6 | 3 | " | " | " |
| C. Ex. 4 | " | " | " | " | " | " | 7 | " | " | " |
| C. Ex. 5 | " | " | " | " | " | " | 10 | " | " | " |

C. Ex.: Comparative Example

| | Initial Characteristics | | Characteristics after copying operation was conducted 20,000 times | |
|---|---|---|---|---|
| | Vo | $E\frac{1}{2}$ | Vo | $E\frac{1}{2}$ |
| Example 1 | 500 | 5.0 | 490 | 5.1 |
| Example 2 | 522 | 4.2 | 510 | 4.0 |
| Example 3 | 535 | 4.0 | 520 | 4.0 |
| Example 4 | 550 | 4.7 | 545 | 4.4 |
| Example 5 | 618 | 4.2 | 615 | 4.5 |
| Example 6 | 630 | 3.9 | 623 | 4.0 |
| Example 7 | 645 | 3.5 | 630 | 3.4 |
| Example 8 | 700 | 3.9 | 698 | 4.1 |
| Example 9 | 468 | 4.3 | 465 | 4.3 |
| Example 10 | 480 | 4.3 | 470 | 4.2 |
| Example 11 | 500 | 4.9 | 500 | 5.1 |
| Example 12 | 535 | 8.2 | 530 | 8.6 |
| Example 13 | 600 | 4.5 | 590 | 4.9 |

-continued

| | Initial Characteristics | | Characteristics after copying operation was conducted 20,000 times | |
|---|---|---|---|---|
| | Vo | E ½ | Vo | E ½ |
| Example 14 | 515 | 4.8 | 510 | 4.7 |
| Example 15 | 545 | 4.1 | 530 | 4.0 |
| Example 16 | 600 | 4.3 | 580 | 4.5 |
| Example 17 | 610 | 4.4 | 570 | 4.5 |
| Comparative Example 1 | 305 | 4.8 | 260 | 8.0 |
| Comparative Example 2 | 340 | 6.5 | 330 | 6.6 |
| Comparative Example 3 | 235 | 5.0 | 270 | no reduction |
| Comparative Example 4 | 250 | 8.5 | 250 | 9.0 |
| Comparative Example 5 | 275 | 9.8 | 262 | 10.0 |

We claim:

1. An organic laminated photosensitive material comprising an electroconductive substrate, a charge-transporting layer formed on the substrate and a charge-generating and transporting layer formed on the charge-transporting layer, wherein the charge-transporting layer is composed of a binder resin containing a hole-transporting substance, and the charge-generating and transporting layer contains a charge-generating substance and a hole-transporting substance at a weight ratio of from 1/3.5 to 1/40 and has a charge-generating substance content of 10 to 1% by weight based on the sum of the hole-transporting substance and binder and a thickness of 5 to 30 μm.

2. A photosensitive material as set forth in claim 1, wherein the charge-generating substance is dibromoanthanthrone, phthalocyanine, Chlorodian Blue or perylene.

3. A photosensitive material as set forth in claim 1, wherein the hole-transporting substance is 1,1-diphenyl-4,4-di-N-diethyl-p-anilyl-1,3-butadiene, N-ethylcarbazole-3-carbaldehydo-diphenylhydrazone, diethylaminobenzaldehydo-diphenylhydrazone or N,N,N',N'-tetraphenylbenzidine.

4. A photosensitive material as set forth in claim 1 wherein the concentration of the charge-generating substance is from 6 to 2% by weight, based on the sum of the hole-transporting substance and binder resin.

5. A photosensitive material as set forth in claim 1 wherein the weight ratio of the charge-generating substance to hole-transporting substance is from 1/5 to 1/20.

6. A photosensitive material as set forth in claim 1 wherein the thickness of the charge-generating and transporting layer is from 10 to 20 microns.

7. A photosensitive material as set forth in claim 1 wherein the hole-transporting substance in the charge-transporting layer is present in an amount of 50 to 300% by weight, based on the binder resin and wherein the thickness of the charge-transporting layer is from 5 to 40 microns.

8. A photosensitive material as set forth in claim 1 wherein the hole-transporting substance is present in an amount of from 75 to 200% by weight, based on the binder resin, and the thickness of the charge-transporting layer is from 10 to 30 microns.

9. A photosensitive material is set forth in claim 2 wherein the hole-transporting substance is 1,1-diphenyl-4,4-di-N-diethyl-p-anilyl-1,3-butadiene, N-ethylcarbazole-3-carbaldehydo-diphenylhydrazone, diethylaminobenzaldehydo-diphenylhydrazone or N,N,N',N'-tetraphenylbenzidine, and is the same in the charge-transporting layer and in the charge-generating and transporting layer.

10. A photosensitive material as set forth in claim 9 wherein the weight ratio of the charge-generating substance to hole-transporting substance in the charge-generating and transporting layer is from 1/5 to 1/20, and wherein the charge-generating substance content in the charge-generating and transporting layer is from 6 to 2% by weight, based on the sum of the hole-transporting substance and binder, and has a thickness of 10 to 20 microns.

* * * * *